US007084777B2

(12) United States Patent
Ninberg

(10) Patent No.: US 7,084,777 B2
(45) Date of Patent: Aug. 1, 2006

(54) FLUID LEAK DETECTION DEVICE

(76) Inventor: Jeffrey A. Ninberg, 12221 Creswick Ct., San Diego, CA (US) 92128

( * ) Notice: Subject to any disclaimer, the term of this patent is extended or adjusted under 35 U.S.C. 154(b) by 77 days.

(21) Appl. No.: 10/654,725

(22) Filed: Sep. 3, 2003

(65) Prior Publication Data

US 2004/0046671 A1 Mar. 11, 2004

Related U.S. Application Data

(60) Provisional application No. 60/409,124, filed on Sep. 5, 2002.

(51) Int. Cl.
*G08B 21/00* (2006.01)

(52) U.S. Cl. ..... 340/605

(58) Field of Classification Search ..... 340/605, 340/604, 603, 608; 200/61.04, 61.05; 137/312
See application file for complete search history.

(56) References Cited

U.S. PATENT DOCUMENTS

| | | | | |
|---|---|---|---|---|
| 3,662,912 | A | 5/1972 | Calle | |
| 3,757,316 | A * | 9/1973 | Fiorenzo | 340/608 |
| 4,013,105 | A | 3/1977 | Uuskallio | |
| 4,246,575 | A * | 1/1981 | Purtell et al. | 340/605 |
| 4,297,686 | A | 10/1981 | Tom | |
| 4,404,516 | A * | 9/1983 | Johnson, Jr. | 324/557 |
| 4,598,273 | A * | 7/1986 | Bryan et al. | 340/539.26 |
| 5,008,652 | A * | 4/1991 | Woloszyk | 340/605 |
| 5,188,143 | A | 2/1993 | Krebs | |
| 5,339,676 | A | 8/1994 | Johnson | |
| 5,637,789 | A | 6/1997 | Lawson | |
| 5,908,411 | A * | 6/1999 | Matsunari | 604/361 |
| 6,035,699 | A | 3/2000 | Parlante | |
| 6,057,770 | A | 5/2000 | Justesen | |
| 6,281,801 | B1 * | 8/2001 | Cherry et al. | 340/605 |
| 6,639,517 | B1 * | 10/2003 | Chapman et al. | 340/605 |
| 6,640,502 | B1 * | 11/2003 | Mueller | 52/22 |

OTHER PUBLICATIONS

Improvements, *Water Leak Alarm*, http://www.improvementscatalog.com/product.asp?product=118224zz&dept%5fid=10930 (last visited Aug. 29, 2003).
DynaQuip Controls, *Water Cop*, http://www.watercop.com (last visited Aug. 29, 2003).

* cited by examiner

*Primary Examiner*—John Tweel, Jr.
(74) *Attorney, Agent, or Firm*—Knobbe Martens Olson & Bear LLP

(57) ABSTRACT

A fluid leak detection device includes a platform having at least one fluid concentration zone forming a fluid detection area. Two electrically conductive members are positioned in the fluid concentration zone such that a gap is formed between the electrically conductive members. A fluid detector is coupled to the electrically conductive members and is configured to generate a fluid detection signal in response to the presence of a fluid between the electrically conductive members. A notification system is coupled to the fluid detector, wherein the notification system is activated in response to the fluid detection signal.

20 Claims, 4 Drawing Sheets

FLUID LEAK DETECTION DEVICE

CROSS REFERENCE TO RELATED APPLICATION

This application claims priority to U.S. Provisional Patent Application 60/409,124 entitled "FLUID LEAK DETECTION DEVICE" and filed on Sep. 5, 2002. The disclosure of the above-described filed application is hereby incorporated by reference in its entirety.

BACKGROUND OF THE INVENTION

1. Field of the Invention

The present invention relates generally to fluid detection, and more particularly to an apparatus to detect leakage of small amounts of fluid.

2. Description of the Related Art

Plumbing, fluid valves, and machinery using fluids such as washing machines, household and industrial fluid distribution and collection systems, both antiquated and new, become more leak prone with increased metal fatigue caused by exposure to vibration, chemical corrosion in fluid containers and conductors, electro-galvanic corrosion caused by dissimilar metals and electrical stimulation, and improper installation. In addition, many plumbing fixtures and machinery using fluids have not been replaced in a timely manner due to economic and environmental restrictions. Much of the currently installed and in-use plumbing, fluid valves, and machinery using fluids are well beyond their design life time, and more are failing every day from design flaws and material defects resulting in fluid leaks and unintentional fluid discharge. With the growing demand to extend the life-time of fluid related systems, there is an increased demand for a practical and cost effective methodology to detect and control fluid leaks.

Thus, there is a need for an effective fluid detection sensor to detect fluid leaks and fluid discharges from fluid systems such as plumbing, fluid valves, and machinery using fluid.

SUMMARY OF THE INVENTION

In one aspect of the invention, a fluid leak detection device and method comprises a platform having at least one fluid concentration zone forming a fluid detection area, a first and second electrically conductive member, positioned in the fluid concentration zone, wherein a gap is formed between the first and second electrically conductive members, a fluid detector coupled to the first and second electrically conductive members and configured to generate a fluid detection signal in response to the presence of a fluid between the first and second electrically conductive members, and a notification system coupled to the fluid detector, wherein the notification system is activated in response to the fluid detection signal.

In additional aspects of the invention, the platform has a low-friction surface, and the platform is folded so as to have a V-shaped cross-section wherein the electrically conductive members are positioned along a central fold of the platform in a substantially parallel configuration. The platform can be resilient and configured to deform such that the device can be positioned under a low profile fluid source. In certain embodiments, the platform is configured to direct fluid to said fluid detection area.

In yet another aspect of the invention, the fluid leak detection device further comprises a plurality of electrically conductive members, wherein the platform is folded to provide a plurality of fluid concentration zones, and a pair of electrically conductive members are positioned in each of the fluid concentration zones such that a gap is formed between each conductive member of each pair of electrically conductive members, and wherein one end of each of the electrically conductive members is coupled to the fluid detector.

In an additional aspect of the invention, the fluid detector comprises a battery having a first terminal and a second terminal, wherein the first terminal of the battery is coupled to a first of the pair of electrically conductive members, and the notification system comprises an indicator having a first terminal coupled to a second of the pair of electrically conductive members and a second terminal coupled to the second terminal of the battery.

The indicator can be an audio indicator and/or a visual indicator, and the notification system can comprise a transmitter configured to transmit a notification signal to an alarm monitoring system in response to receipt of the fluid detection signal.

In yet another aspect of the invention, a fluid detection device comprises a corrugated platform having a plurality of folds forming a plurality of fluid concentration troughs and having a pair of electrically conductive members positioned along each fluid concentration trough of the plurality of folds, a power source having a first terminal and a second terminal, the first terminal coupled to a first electrically conductive member of each pair of electrically conductive members, and a fluid detection indicator comprising a first terminal coupled to a second electrically conductive member of each pair of electrically conductive members, and a second terminal coupled to the second terminal of the battery, wherein the fluid detection indicator is activated in response to fluid present between any of the pairs of electrically conductive members.

The fluid detection indicator can comprise an audio indicator and/or a visual indicator, and the power source can be a battery. In certain embodiments of the invention, the platform has a low-friction surface, the electrically conductive members can be metallic strips, and the platform can be resilient and deformable.

In yet another aspect of the invention, a fluid leak detection device comprises a folded, lightweight platform with a low-friction surface having a fluid concentration trough in a region proximate a central fold, a pair of electrically conductive members positioned along the fluid concentration trough, wherein a gap is formed between the electrically conductive members proximate a lowest point of the fluid concentration trough, a battery having a first terminal and a second terminal, wherein the first terminal is coupled to one end of a first electrically conductive member of the pair of electrically conductive members, and an audible fluid detection indicator having a first terminal coupled to one end of a second electrically conductive member of the pair of electrically conductive members, and a second terminal coupled to the second terminal of the battery, wherein the audible indicator is activated in response to the presence of fluid between the first and second electrically conductive members.

The audible fluid detection indicator can be a piezo buzzer, and may further comprise a visual fluid detection indicator. In addition, the electrically conductive members can be metallic strips.

DETAILED DESCRIPTION OF THE PREFERRED EMBODIMENT

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

In one aspect of the invention, fluid leaks and discharges can be detected over physically large areas by providing a practical and economical system and method of detection. The large area for detection of fluid leaks and discharge results in increased effectiveness and reliability of the detection system.

In one embodiment, a fluid detection system comprises a platform with a fluid concentrator or director, an electronic fluid sensor, audio and visual indicators, automatic emergency agency notification system, and an automatic termination of fluid flow system responsive to fluid detection. Leaking fluid falling onto the platform is concentrated into a fluid detection area using a gravity fed ramp to concentrate the fluid into the desired fluid detection area. The fluid can be detected using an electronic sensor, and an audio and/or visual alert indicator can be activated in response to fluid detection. In addition, an emergency alert agency can be notified and the fluid flow from the source can be terminated by an electrically controlled valve in response to leak detection by the system.

One embodiment of a fluid detection device includes a slanted platform with a low coefficient of friction with respect to fluids such as water, a pair of wires proximal to a fluid concentration zone of the platform, and an indicator coupled to the wires. The platform is placed in an area where possible fluid release occurs from above the platform and is configured such that fluid collects on the platform in an area proximal to the pair of wires according to the directional pull of gravity on the fluid. As the fluid collects between the wires, the fluid bridges a gap between the two wires, or reduces electrical resistance between the wires, to activate the indicator. Of course, the invention is not limited to the use of wires. Any material that conducts electricity and completes a circuit is contemplated.

In one embodiment of the invention, the indicator is a battery and a piezo buzzer. Each wire is connected to a terminal on the battery and a piezo buzzer is coupled along one of the wires. As fluid collects between the wires, the fluid completes the circuit between the battery terminals, thereby activating the piezo buzzer.

Figure 1:
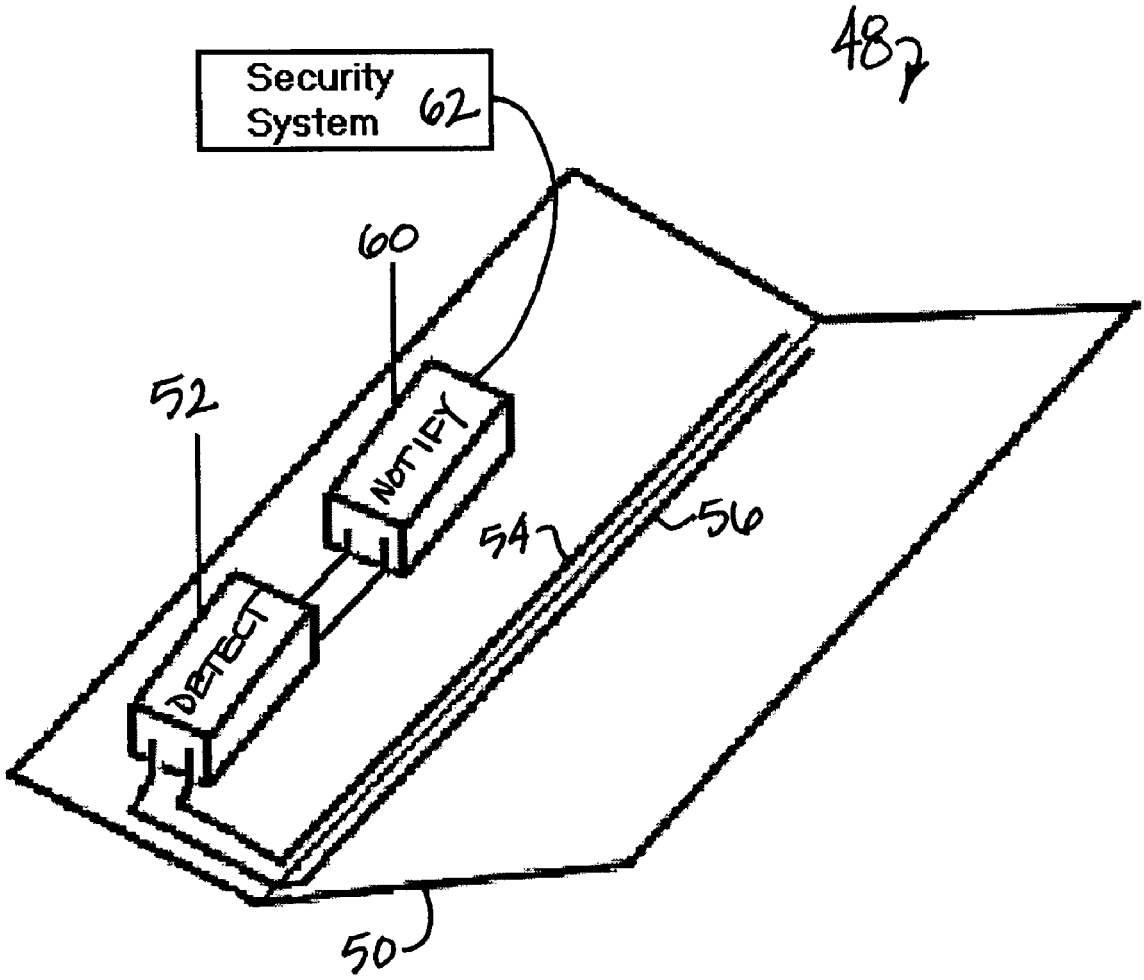
FIG. 1 is a perspective view illustration of a fluid detection device.

FIG. 1 is a perspective view illustration of one embodiment of a fluid detection device 48. The device 48 includes a fluid concentrator or director 50, a fluid sensor comprising a detector 52 and a pair of electrically conductive members 54, 56, and a notification system 60.

The fluid concentrator 50 is a folded rectangular platform having a generally "V" shaped cross-section such that a center fold forms two platform portions intersecting at an angle less than 180° with a fluid concentration zone or trough along the center fold. The conductive members 54, 56 are positioned along the length of the center fold in a substantially parallel configuration such that a gap is formed between them proximate the lowest point of the fluid concentration trough. The first conductive member 54 is coupled to a first terminal of the detector 52, and the second conductive member 56 is coupled to a second terminal of the detector 52. The conductive members 54, 56 can be any electrically conductive material such as uninsulated or partially insulated wires, electrically conductive strips, metallic strips such as those implemented on printed circuit boards, or any combination thereof.

The folds of the platform 50 can be flexible and resilient such that the "V" shape is generally maintained but deformable such that the device can be flattened and positioned under a low profile device while maintaining the fluid concentration trough. The platform portions are advantageously made of a material, or coated with a material, providing a low coefficient of friction for fluids, such that fluid contacting the surface gravitates toward the central fold of the fluid concentrator 50 with little resistance from the surface of the platform. In one embodiment, the platform comprises plastic, although coated metal or paper surfaces can be used. In certain advantageous embodiments, the platform, or portions of the platform, is made of a lightweight material such as fiberglass. In addition, the platform, or surface of the platform which collects or contacts fluid, can have a coating which provides a low coefficient of friction, such as a silicon-based product.

Furthermore, the platform 50 is not limited to a unitary structure, and can comprise a plurality of platform portions coupled by semi-rigid connecting means. In addition, the platform is not limited to a uniform geometric configuration, and other configurations of the platform having a slanted or sloped surface, such as a bowl, so as to direct fluid to a detection area by the force of gravity are included in the scope of the invention.

The detector 52 comprises a battery, a detector circuit, and an activation circuit configured to activate the notification system 60. In certain embodiments, electrically conductive fluid collected in the trough of the fluid concentrator 50 electrically bridges the gap between the conductive members 54, 56. That completes a circuit or reduces electrical resistance in the detector 52, which then generates a fluid detection signal or notification system activation signal. In response to fluid detection, the activation circuit activates the notification system 60 by, for example, closing a switch such as a diode or transistor coupled between the battery and the notification system. In certain embodiments, the detector further comprises a voltage amplifier to increase the voltage provided by the battery to the notification system 60.

It will be appreciated that the detector 52 can comprise various combinations of electronic elements and devices, including active and passive devices, for the implementation of the detection and activation circuitry. As it is well within the skill of one in the art to develop and implement a fluid detection circuit and an activation circuit as contemplated herein, detailed discussion of such elements of the fluid detection system are omitted.

In one embodiment, the notification system 60 comprises an audio indicator such as a buzzer, and a visual indicator such as a light emitting diode (LED). The notification system 60 can be coupled to the battery in the detector 52 or can be powered independently. The detector 52 and notification system 60 are not limited to the illustrated and described position as mounted on the fluid concentrator 50, and can be located adjacent to or remote from the fluid concentrator 50. Furthermore, the detector 52 and notification system are not limited to battery powered operation, and can include connection to an AC power source.

In certain embodiments, the notification system 60 comprises an emergency agency notification system. For example, the notification device 60 can be coupled to a home security system 62 which is monitored by a security agency. An appropriate signal is sent to the security system 62 in response to fluid detection, thereby notifying the monitoring agency of detection of a fluid leak.

The notification system 60 can further comprise means for terminating fluid flow or operation of the fluid source in response to fluid detection. For example, a leak detection signal can be transmitted by the notification system to an electronically actuated shut-off valve of a fluid source.

In some embodiments, the notification system 60 includes a transmitter configured to transmit a detection signal to a remote location, wherein the signal is transmitted via wireless or hardwired communication link, or a combination thereof. For example, a detection signal can be wirelessly transmitted using radio frequency (RF). Bluetooth, or IEEE 802.11 communication devices. Alternatively, a detection signal can be transmitted over a standard telephone line or network cable line. The detection signal can be transmitted, for example, to a monitoring system, a cellular telephone, a pager, a personal digital assistant (PDA), or an email account.

Figure 2:
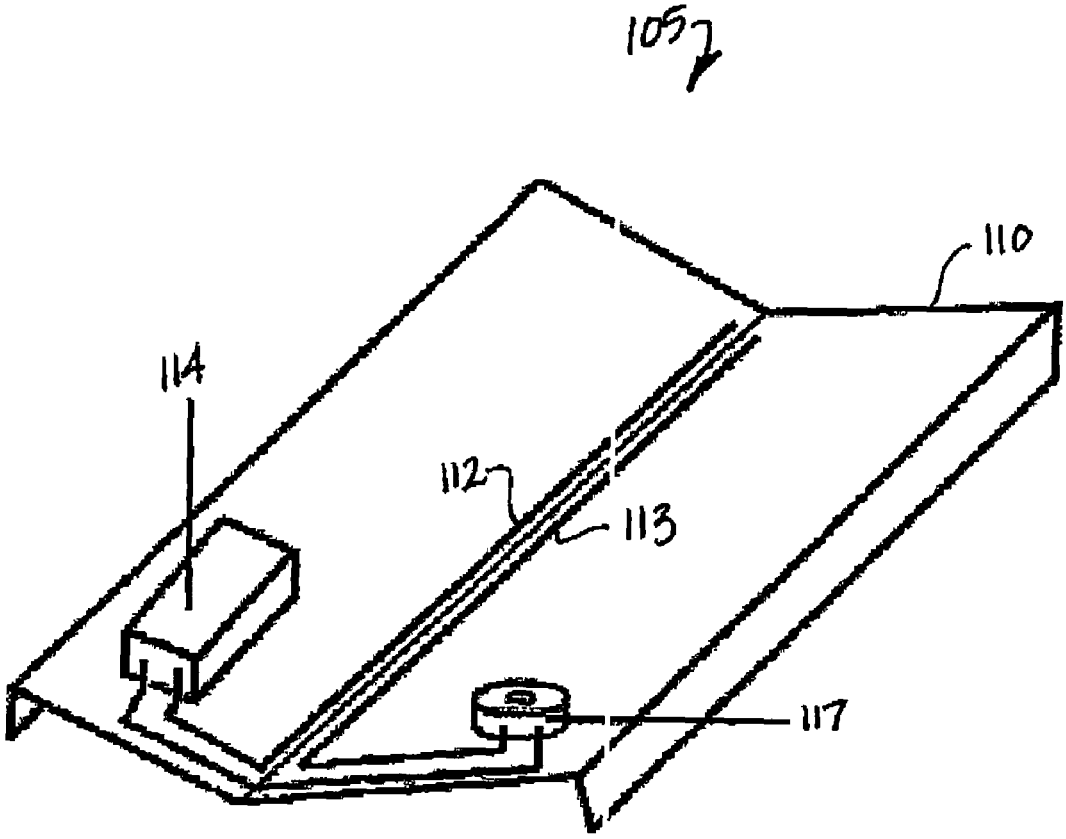
FIG. 2 is a perspective view illustration of a fluid detection device.

One embodiment of a fluid leak detection device 105 is illustrated in FIG. 2. The detection device 105 comprises a folded rectangular platform 110 having a generally "M" shaped cross-section or side-view, such that three folds form four platform portions. A pair of uninsulated wires 112, 113 are positioned in a parallel configuration along a central fold of the platform such that a gap is formed between the wires 112, 113 along the central fold. The first wire 112 is coupled to a first terminal of a low voltage battery 114, and a second battery terminal is coupled to a first terminal of a piezo buzzer 117. The second wire 113 is coupled to a second terminal of the piezo buzzer 117.

The folds of the platform 110 can be flexible and resilient such that the "M" shape is generally maintained but deformable such that the device can be flattened and positioned under a low profile device such as a clothes washing machine. The two central platform portions, proximal to the center fold of the platform 110, are advantageously made of a material, or coated with a material, providing a low coefficient of friction for fluids, such that fluid contacting the surface gravitates toward the central fold of the platform 110 with little resistance from the surface of the platform 110.

In one exemplary operation, the fluid detection device 105 is placed below a washing machine or other fluid containing structure, such that water leaking from the bottom of the washing machine flows onto the platform 110. As water released from the washing machine contacts the platform 110, gravity causes the water to flow to the lowest point of the platform 110, which is the center fold of the embodiment of the device illustrated in FIG. 2. The water collected at the center fold of the platform 10 electrically bridges the gap between the wires 112, 113, thereby completing the circuit between the battery 114 and the piezo buzzer 117 and activating the audible piezo buzzer alarm. The piezo buzzer alarm 117 remains activated as long as fluid is present between the wires 112, 113.

Figure 3:
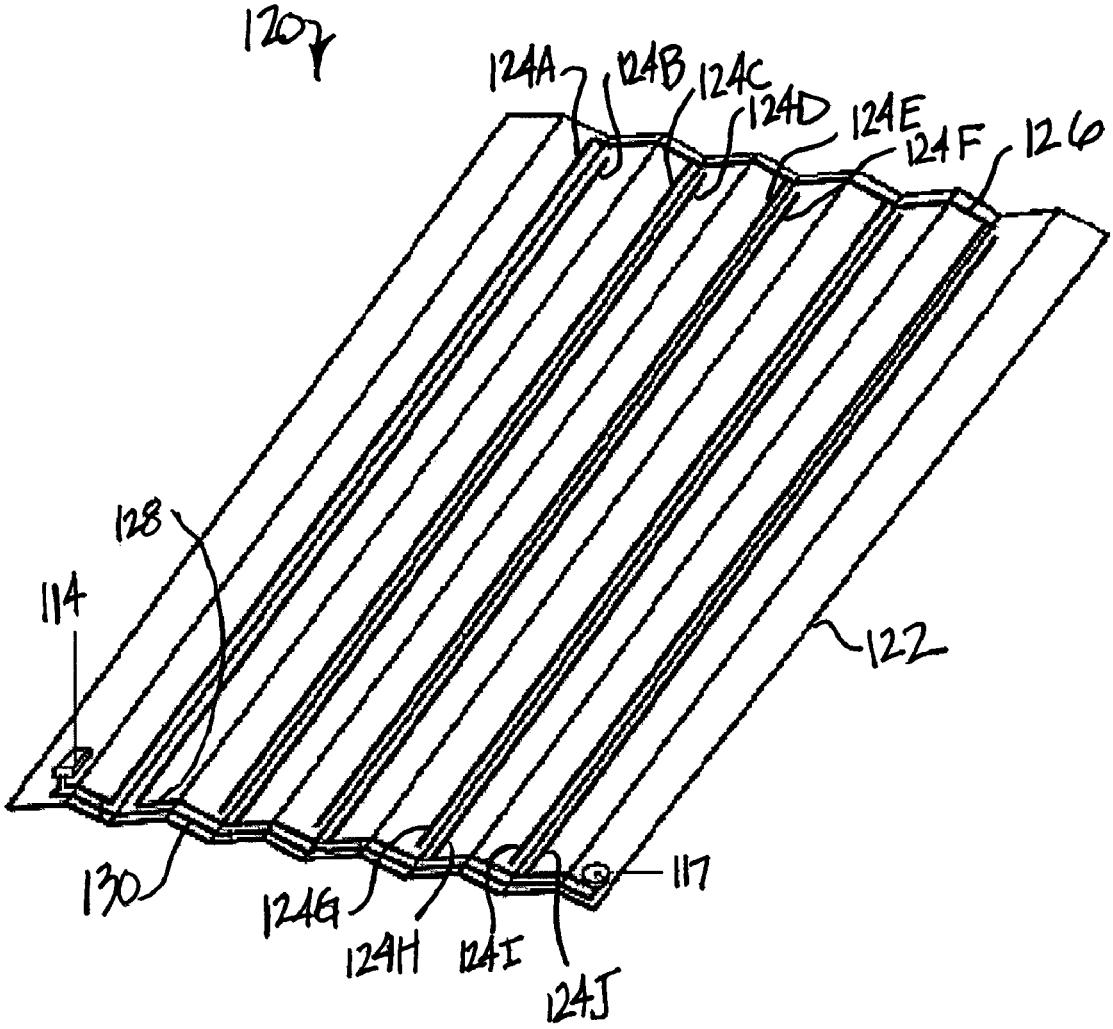
FIG. 3 is a perspective view illustration of a fluid detection device.

FIG. 3 is a perspective view illustration of another embodiment of a fluid detection device 120, similar to the device 105 illustrated in FIG. 2, wherein a corrugated platform 122 comprises a plurality of folds dividing the platform into a plurality of platform portions. The platform portions form multiple fluid detection areas or troughs, wherein two electrically conductive members 124A–J are positioned substantially parallel along the length of each trough such that a gap is present between the two conductive members 124A–J.

A first parallel conductive member 124A is coupled at one end to the first terminal of the battery 114 and at a second end to a first transverse conductive member 126, wherein the first transverse conductive member 126 is coupled to one end of a first conductive member 124A, 124C, 124E 124G, 124I of each pair of conductive members 124A–J. A second transverse conductive member 128 is coupled at a first end to the second conductive member 124B and at a second end to the piezo buzzer 117, and an end of a second conductive member 124D, 124F, 124H, 124J of each pair of conductive members 124A–J is coupled to the second transverse conductive member 128. A third transverse conductive member 130 has a first end coupled to a terminal of the battery 114 and a second end coupled to a second terminal of the piezo buzzer 117. The piezo buzzer 117 is activated in response to the presence of fluid between any two conductive members 124A–J in each concentration trough.

The fluid detection device 120 provides both a larger area for receiving fluid and a larger detection area wherein multiple fluid detection areas are implemented, thereby increasing the probability of fluid detection in response to fluid contact with the detection device 120. It will be appreciated that the configuration of the electrically conductive members and the platform are exemplary in nature, and other configurations are within the scope of the invention.

Figure 4:
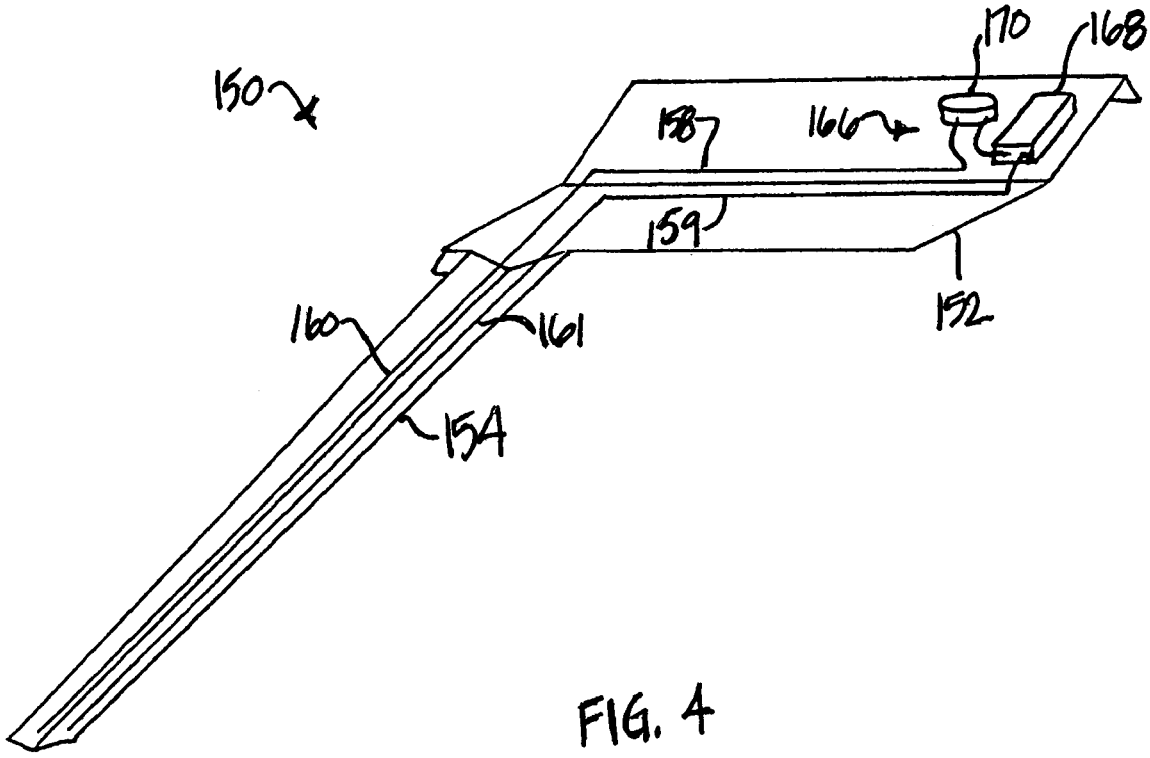
FIG. 4 is a perspective view illustration of a fluid detection device.

FIG. 4 is a perspective view illustration of yet another embodiment of a fluid detection device 150 comprising a main platform 152 and an auxiliary platform 154. The main and auxiliary platforms 152, 154 are coupled in a perpendicular, L-shape, and each platform 152, 154 is divided into two platform portions by a central fold such that a substantially V-shaped fluid concentration trough is formed in each platform 152, 154. A first pair of electrically conductive members 158, 159 are positioned along the trough of the main platform 152 such that gap is formed between the conductive members 158, 159 along the concentration trough. Similarly, a second pair of electrically conductive members 160, 161 are positioned along the trough of the auxiliary platform 154 such that a gap is formed between the conductive members 160, 161 along the concentration trough. The first pair of electrically conductive members 158, 159 are coupled at one end to the second pair of electrically conductive members 160, 161 in a perpendicular, L-shaped configuration, similar to the configuration of the main and auxiliary platforms 152, 154.

Each of the conductive members of the first pair of electrically conductive members 158, 159 is coupled to a respective terminal of an electronic fluid sensor and notification device 166. In one embodiment, the fluid sensor and notification device 166 comprise a battery 168 and an audible alarm 170, wherein the presence of fluid between either pair of electrically conductive members 158, 159,

160, 161 will complete the circuit between the battery 168 and the audible alarm 170, thereby activating the alarm 170.

Embodiments of the invention are not limited to the specific detection devices described above. The platform may be of a plurality of geometries and configurations, and the components can be located in a plurality of locations and orientations. For example, a central portion of the platform may be of a generally conical or inverted pyramid shape so as to provide a smaller low-point for fluid to collect as a result of gravitational pull. In addition, the platform may be curvilinear so as to adapt to a curved environment such as the area surrounding a toilet.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A fluid leak detection device, comprising:

a platform having at least one fluid concentration zone forming a fluid detection area extending substantially along the length of the platform;

a first and second electrically conductive member, positioned in said fluid concentration zone, wherein a gap is formed between said first and second electrically conductive members, wherein said electrically conductive members extend substantially along the length of said platform;

a fluid detector comprising a battery coupled to said first and second electrically conductive members and configured to generate a fluid detection signal in response to the presence of a fluid between said first and second electrically conductive members, said battery having a first terminal and a second terminal, wherein said first terminal is coupled to said first electrically conductive member; and a notification system comprising an indicator having a first terminal coupled to said second electrically conductive member and a second terminal coupled to said second terminal of said battery, wherein said notification system is activated in response to said fluid detection signal.

2. The device of claim 1, wherein said platform has a low-friction surface.

3. The device of claim 1, wherein said platform is folded so as to have a V-shaped cross-section and said first and second electrically conductive members are positioned along a central fold of said platform in a substantially parallel configuration, and wherein said first and second electrically conductive members extend substantially along the length of said folded platform.

4. The device of claim 1, wherein said platform is resilient and configured to deform such that the device can be positioned under a low profile fluid source.

5. The device of claim 1, wherein said platform is configured to direct fluid to said fluid detection area.

6. The device of claim 1, further comprising a plurality of electrically conductive members, wherein said platform is folded to provide a plurality of fluid concentration zones, and a pair of said electrically conductive members are positioned in each of said fluid concentration zones such that a gap is formed between each conductive member of each pair of electrically conductive members, and wherein one end of each of said electrically conductive members is coupled to said fluid detector.

7. The device of claim 1, wherein said indicator is at least one of an audio indicator and a visual indicator.

8. The device of claim 1, wherein said notification system comprises a transmitter configured to transmit a notification signal to an alarm monitoring system in response to receipt of said fluid detection signal.

9. A fluid detection device, comprising:

a corrugated platform having a plurality of folds forming a plurality of fluid concentration troughs and having a pair of electrically conductive members positioned along each fluid concentration trough of said plurality of folds and extending substantially along the length of each fluid concentration trough;

a power source having a first terminal and a second terminal, said first terminal coupled to a first electrically conductive member of each pair of electrically conductive members; and a fluid detection indicator comprising a first terminal coupled to a second electrically conductive member of each pair of electrically conductive members, and a second terminal coupled to said second terminal of said power source, wherein said fluid detection indicator is activated in response to fluid present between any of said pairs of electrically conductive members.

10. The fluid detection device of claim 9, wherein said fluid detection indicator comprises an audio indicator.

11. The fluid detection device of claim 9, wherein said fluid detection indicator comprises a visual indicator.

12. The fluid detection device of claim 11, wherein said fluid detection indicator further comprises an audio indicator.

13. The fluid detection device of claim 9, wherein said power source is a battery.

14. The fluid detection device of claim 9, wherein said platform has a low-friction surface.

15. The fluid detection device of claim 9, wherein said electrically conductive members are metallic strips.

16. The fluid detection device of claim 9, wherein said platform is resilient and deformable.

17. A fluid leak detection device, comprising:

a folded, lightweight platform with a low-friction surface having a fluid concentration trough in a region proximate a central fold;

a pair of electrically conductive members positioned along said fluid concentration trough and substantially along the length of said platform, wherein a gap is formed between said electrically conductive members proximate a lowest point of said fluid concentration trough;

a battery having a first terminal and a second terminal, wherein said first terminal is coupled to one end of a first electrically conducive member of said pair of electrically conductive members; and an audible fluid detection indicator having a first terminal coupled to one end of a second electrically conductive member of said pair of electrically conductive members, and a second terminal coupled to said second terminal of said battery, wherein said audible indicator is activated in response to the presence of fluid between said first and second electrically conductive members.

18. The fluid leak detection device of claim 17, wherein said audible fluid detection indicator is a piezo buzzer.

19. The fluid leak detection device of claim 17, further comprising a visual fluid detection indicator.

20. The fluid leak detection device of claim 17, wherein said electrically conductive members are metallic strips.

* * * * *